US005157367A

United States Patent [19]

Itoh et al.

[11] Patent Number: 5,157,367

[45] Date of Patent: Oct. 20, 1992

[54] ELECTROMAGNETIC SWITCHGEAR

[75] Inventors: Koichi Itoh; Yuko Yamamoto; Takeshi Sugiyama, all of Hyogo, Japan

[73] Assignee: Mitsubishi Denki K.K., Tokyo, Japan

[21] Appl. No.: 734,659

[22] Filed: Jul. 23, 1991

[30] Foreign Application Priority Data

Jul. 31, 1990 [JP] Japan ..... 2-204188

[51] Int. Cl.[5] ..... H01H 67/02

[52] U.S. Cl. ..... 335/126; 335/131

[58] Field of Search ..... 375/126, 131

[56] References Cited

U.S. PATENT DOCUMENTS 4,825,180 4/1989 Miyaji .
4,853,570 8/1989 Isozumi et al. .
4,881,416 11/1989 Isozumi .
4,983,940 1/1991 Konishi ..... 335/126
5,023,581 6/1991 Sugiyama ..... 335/126

FOREIGN PATENT DOCUMENTS 56-31006 7/1981 Japan .
63-41733 11/1988 Japan .

*Primary Examiner*—Lincoln Donovan
*Attorney, Agent, or Firm*—Sughrue, Mion, Zinn, Macpeak & Seas

[57] ABSTRACT

An electromagnetic switchgear wherein an eyelet is used to secure an external terminal at a lead hole for use in leading lead conductors of coils to the outside, wherein the lead conductors of the coils are led out of the eyelet, and wherein the lead conductors of the coils, the eyelet and the external terminal are connected together, characterized by applying a tap or protrusion between the interior of the eyelet and the ends of the lead conductors of the coils in order to connect them with solder.

8 Claims, 2 Drawing Sheets

ELECTROMAGNETIC SWITCHGEAR

BACKGROUND OF THE INVENTION

1. Field of the Invention

The present invention relates to a contact mechanism in an electromagnetic switchgear having a coil lead portion to be connected to an external terminal.

2. Prior Art

FIG. 4 is an overall sectional view of a conventional electromagnetic switchgear.

An electromagnetic switchgear 1 of the sort shown in FIG. 4 has a magnetic path casing 2, and an exciting coil 3 which is wound on a plastic bobbin 4. The exciting coil 3 consists of an absorbing coil 3*a* of thick conductor and a holding coil 3*b* of thin conductor. A spool 31 for winding the coils is provided at the rear end of the bobbin 4; the lead conductor 30*a* of the absorbing coil 3*a* and the lead conductor 30*b* of the holding coil 3*b* are led out therefrom, respectively. Further, the electromagnetic switchgear 1 further has a fixed iron core 5, a guide bushing 6 made of non-magnetic material, the guide bushing 6 being fitted to the inner periphery of the bobbin 4 and secured to the fixed iron core 5, a moving iron core 7 opposite to the fixed iron core 5, the moving iron core 7 being supported in such a way that it is slidable on the inner periphery of the guide bushing 6 in the axial direction, a hook 8 with its rear end portion inserted into a hole 7*a* bored in the moving iron core 7, and a shift lever 9 for moving a start overrunning clutch (not shown), the upper end of the shift lever 9 being coupled to the hook 8. Further, the electromagnetic switchgear 1 has a spring receptacle 10 secured at the outlet of the hole 7*a*, a buffer spring 11 for pressing the hook 8 in the backward direction, a reset spring 12 for advancing and resetting the moving iron core 7, and a resin-molded cap 13 coupled via a rubber packing 14 to the end of the fixed iron core 5 and caulked at the end of the magnetic path casing 2. Moreover, the electromagnetic switchgear 1 has a pair of fixed contacts 15*a*, 15*b* (only one of which is shown), their terminal bolts 16 being passed through the cap 13 outwardly and fixed. The terminal of a lead wire from a power supply (storage battery) is connected to one terminal bolt 16, whereas the terminal of a lead wire for the brush of an electric motor is connected to the other terminal bolt. In addition, the electromagnetic switchgear 1 has a moving contact 20 opposite to the pair of fixed contacts 15*a*, 15*b* and supported with a moving rod 21 via an insulating member 22, a retaining ring 23, a compression spring 24 for giving the moving contact 20 a contact pressure, a compression spring 25 for advancing and resetting the moving rod 21, and an external terminal 32 connected to the lead conductors 30*a*, 30*b* of the coils with solder 33, the external terminal 32 also being connected to a lead wire from a start switch of an internal combustion engine.

The operation of the electromagnetic switchgear will subsequently be described. When the start switch (not shown) is actuated, the absorbing coil 3*a* and the holding coil 3*b* are caused to conduct and the moving iron core 7 is attracted to the fixed iron core 5 and thereby moves back. The hook 8 also moves back to rotate the shift lever 9, thus advancing the overrunning clutch (not shown). On the other hand, the moving contact 20 that is geared to the backward movement of the moving iron core 7 is moved back to close the fixed contacts 15*a*, 15*b*. Power is thus supplied to the circuit of the electric motor so as to rotate its armature.

A description will then be given of the state in which the external terminal 32 is kept in contact with the lead conductors 30*a*, 30*b* with reference to FIGS. 5, 6. As shown in FIGS. 5, 6, the external terminal 32 is mounted on the cap 13 with an eyelet 34, whereas the lead conductors 30*a*, 30*b* of the coils are led out of an outlet hole 34*a* of the eyelet 34 and secured thereto with solder 33. The lead conductors 30*a*, 30*b* are thus electrically connected to the external terminal 32.

In the prior art example of FIG. 5, the known practice is to insert an insulating tube 35 into the eyelet 34 to prevent the solder 33 from sagging into the electromagnetic switchgear from the gap between the inner periphery of the eyelet 34 and the lead conductors 30*a*, 30*b* of the coils.

FIG. 6 illustrates an eyelet 34 whose inner diameter has been reduced to decrease the gap between the inner periphery of the eyelet 34 and the lead conductors 30*a*, 30*b*.

In the case of the conventional electromagnetic switchgear, it is advantageous to use such a common eyelet 34 for securing the external terminal 32 when not only the number of parts but also processability is taken into consideration. This naturally tends to render the inner diameter of the eyelet 34 greater. Consequently as shown in FIG. 5, the insulating tube 35 is required to prevent solder from sagging during the process of soldering the lead conductors 30*a*, 30*b* of the coils. Notwithstanding, the laborious work of inserting the insulating tube 35 still makes it difficult to mechanize this process and besides complete solder-sagging prevention remains unaccomplished.

Even into the reduced inner diameter as shown in FIG. 6, the eyelet 34 still fails to ensure complete solder-sagging prevention, and for this reason, makes it difficult to insert the lead conductors 30*a*, 30*b* of the coils into the inner periphery of the eyelet 34, thus causing the faulty insertion of lead conductors.

SUMMARY OF THE INVENTION

An object of the present invention is to solve the foregoing problems by providing an electromagnetic switchgear ensuring high processability when lead conductors of coils are connected to an external terminal without increase in the number of parts and also ensuring that solder is prevented from sagging.

An electromagnetic switchgear according to a first invention is characterized by applying a tap between the interior of an eyelet and the ends of lead conductors of coils in order to connect them with solder.

An electromagnetic switchgear according to a second embodiment of the invention is characterized by inserting a partial protrusion of a coil winding spool into an eyelet.

Solder is thus prevented from sagging into the electromagnetic switchgear when the lead conductors of the coils are connected to the external terminal according to the first and the second embodiments of the invention.

DETAILED DESCRIPTION OF THE PREFERRED EMBODIMENTS

Embodiments of the present invention will subsequently be described with reference to the accompanying drawings.

Figure 1:
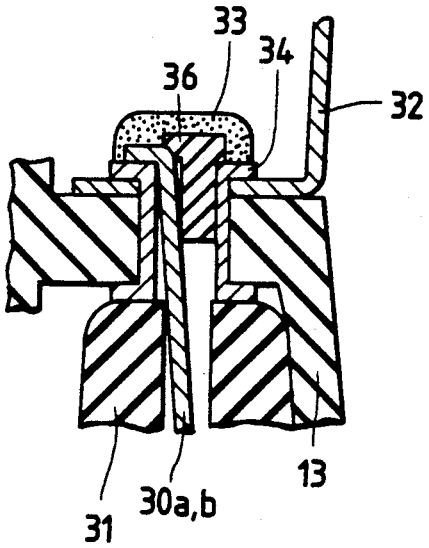
FIG. 1 is a sectional view of the principal part of an electromagnetic switchgear embodying the first embodiment of the invention.
Figure 4:
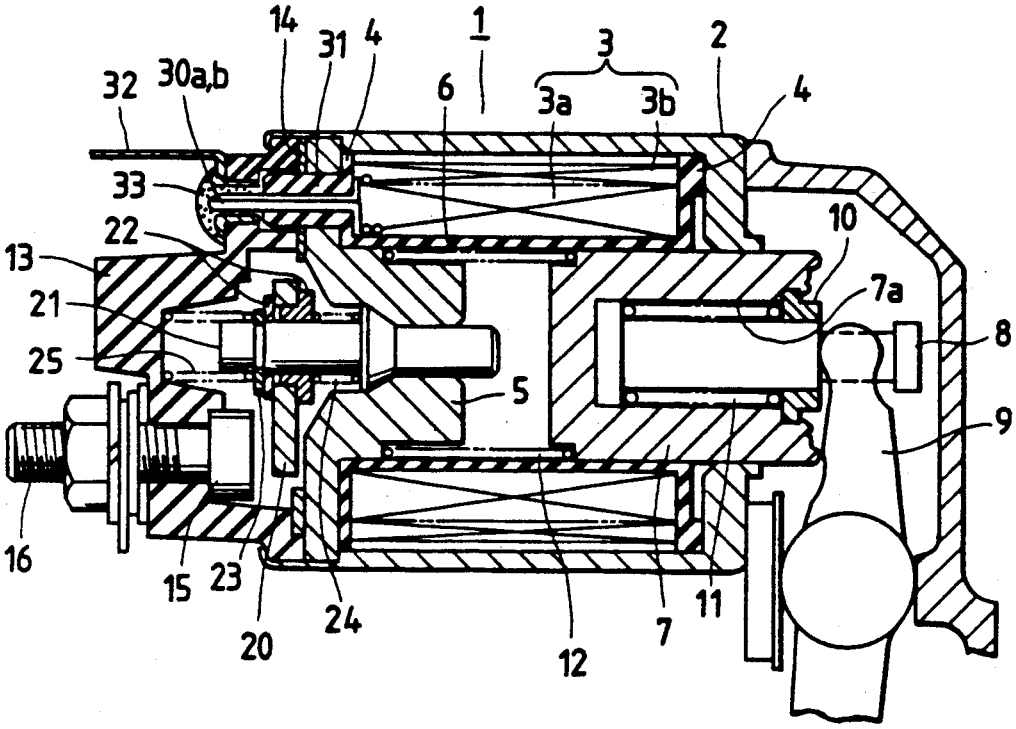
FIG. 4 is an overall sectional view of a conventional electromagnetic switchgear.
Figure 5:
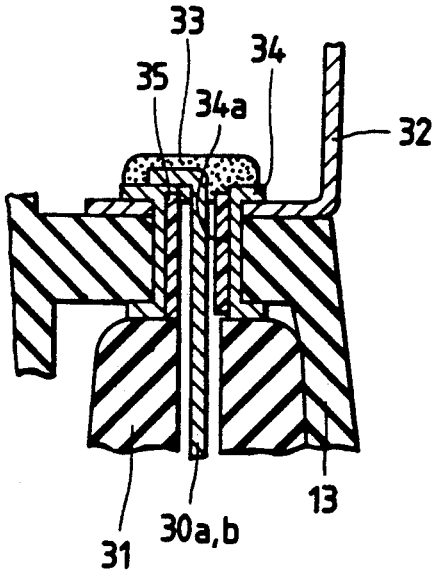
FIG. 5 PRIOR ART
FIGS. 5, 6 are sectional views of respective connections between an external terminal and lead conductors of coils in the conventional switchgear.

FIG. 1 is a sectional view of the principal part of an electromagnetic switchgear embodying a first embodiment of the invention. In FIG. 1, a tap 36 is made of nylon and T-shaped in vertical section. The construction of the electromagnetic switchgear is similar to that of the conventional one shown in FIGS. 4–6 and therefore the description thereof will be omitted.

A description will then be given of the work of assembling this embodiment. First, an external terminal 32 is secured to a cap 13 by means of an eyelet 34 and lead conductors 30*a*, 30*b* of coils led out via a coil winding spool 31 is further led out of the interior of the eyelet 34, the leading ends of the conductors being bent therein. After the nylon tap 36 is inserted or forced in from the outside, it is fixed with solder 33, so that the series of components including solder 33, eyelet 34 and external terminal 32 is electrically connected. In this case, the tap 36 may be made of resin other than nylon.

Figure 2:
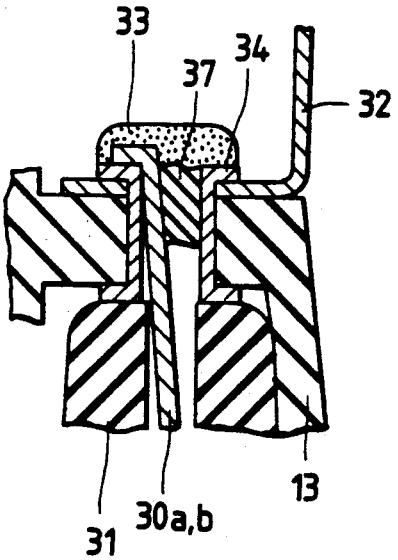
FIG. 2 is a sectional view of the principal part of another electromagnetic switchgear embodying the first embodiment of the invention.

FIG. 2 is a sectional view of the principal part of another electromagnetic switchgear embodying the first embodiment of the invention. In FIG. 2, a tap 37 is made of glass fiber. As in the case of the embodiment previously described, the tap 37 of glass fiber is also inserted into the eyelet 34 before being soldered to prevent solder-sagging. In this case, the tap 37 may be made of fiber other than glass fiber.

Figure 3:
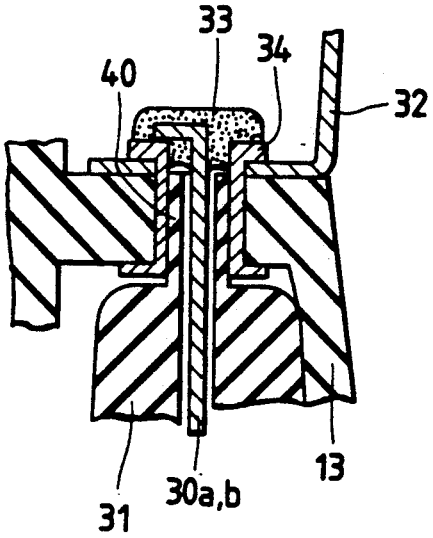
FIG. 3 is a sectional view of the principal part of an electromagnetic switchgear embodying the second embodiment of the invention.

FIG. 3 is a sectional view of the principal part of an electromagnetic switchgear embodying a second embodiment of the invention. In FIG. 3, a cylindrical protrusion 40 is protruded from the end portion of the coil winding spool 31 and formed so that it can be inserted into the eyelet 34. The coil winding spool 31 is usually made of nylon or the like and the protrusion 40 in the eyelet 34 is also made of resin. In this case, the remaining construction of the electromagnetic switchgear is also similar to that of the conventional one shown in FIGS. 4–6 and therefore the description thereof will be omitted.

The effect of the present invention may be summarized with reference to the embodiments described above as follows: (1) The temperature of a soldering bit for soldering is only slightly transmitted to the protrusion 40 and the protruded portion is kept at low temperatures. When the solder 33 melts and comes in contact with the protrusion 40, the temperature of the solder 33 decreases and it solidifies in that portion. The solder is thus prevented from sagging.

(2) As the protrusion 40 is made of resin, it is free from wetting and repels the solder accordingly. The apparent gap through which the solder may passes becomes smaller than an actual one and the solder is thus prevented from sagging accordingly.

Figure 6:
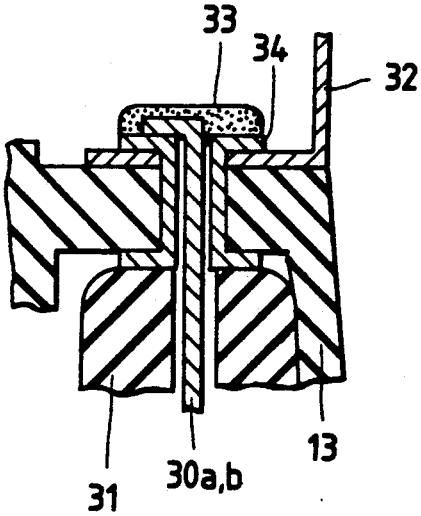
FIG. 6 PRIOR ART

(3) With the effect (2), it is not necessarily needed to strictly decrease the gap as in the case of the prior art example (FIG. 6). The gap between the protrusion 40 and the eyelet 34 is set tolerable to a certain extent to ensure productivity during the process of inserting the protrusion 40 into the eyelet 34.

As set forth above, solder is completely prevented from sagging without the necessity of additional parts and trouble when the lead conductors of the coils and the external terminal are connected with solder.

What is claimed is:

1. An electromagnetic switchgear having a contact mechanism for connecting a lead conductor of coils to an external terminal, said contact mechanism comprising:
   - a cap having a lead hole for leading said lead conductor to said external terminal;
   - an eyelet for securing said external terminal at said lead hole; and
   - a tap provided between the interior of said eyelet and the end of said lead conductors, said eyelet being connected with solder to said lead conductor and said tap.

2. An electromagnetic switchgear as claimed in claim 1, wherein said tap is made of nylon.

3. An electromagnetic switchgear as claimed in claim 1, wherein said tap is made of glass fiber.

4. A switchgear as claimed in claim 1, wherein said tap is T-shaped.

5. An electromagnetic switchgear having a contact mechanism for connecting a lead conductor of coils to an external terminal, said contact mechanism comprising:
   - a cap having a lead hole for leading said lead conductor to said external terminal;
   - an eyelet for securing said external terminal at said lead hole; and
   - a coil winding spool having a protrusion for winding said coils, said protrusion being inserted into the interior of said eyelet, said eyelet being connected to said external terminal with solder.

6. An electromagnetic switchgear as claimed in claim 5, wherein said protrusion of said coil winding spool is cylindrical.

7. An electromagnetic switchgear as claimed in claim 5, wherein said protrusion of said coil winding spool is made of resin.

8. A method of connecting a lead conductor of coils to an external terminal in an electromagnetic switchgear, said method comprising the steps of:
   - securing said external terminal to a lead hole of a cap by an eyelet;
   - leading out said lead conductor of coils out of the interior of said eyelet;
   - bending an end of said lead conductor;
   - inserting a tap or protrusion into the interior of said eyelet from the outside; and
   - fixing said lead conductor to said external terminal through said eyelet with solder so that the solder, said eyelet, and said external terminal are electrically connected together.

* * * * *